US010738980B2

(12) United States Patent
Worman

(10) Patent No.: US 10,738,980 B2
(45) Date of Patent: Aug. 11, 2020

(54) FLASHLIGHT WITH REAR-FACING SIGNAL LIGHT AND MODULAR INTEGRATED MOUNT SYSTEM

(71) Applicant: Streamlight, Inc., Eagleville, PA (US)

(72) Inventor: William D. Worman, Audubon, PA (US)

(73) Assignee: STREAMLIGHT, INC, Eagleville, PA (US)

( * ) Notice: Subject to any disclaimer, the term of this patent is extended or adjusted under 35 U.S.C. 154(b) by 0 days.

(21) Appl. No.: 16/107,052

(22) Filed: Aug. 21, 2018

(65) Prior Publication Data

US 2020/0063949 A1 Feb. 27, 2020

(51) Int. Cl.

| | |
|---|---|
| ***F21V 21/088*** | (2006.01) |
| ***F21V 21/084*** | (2006.01) |
| ***A42B 3/04*** | (2006.01) |
| ***F21L 4/02*** | (2006.01) |
| ***F21V 33/00*** | (2006.01) |
| ***H05B 47/10*** | (2020.01) |

(52) U.S. Cl.

CPC ..... *F21V 21/084* (2013.01); *A42B 3/0446* (2013.01); *F21L 4/027* (2013.01); *F21V 21/0885* (2013.01); *F21V 33/0064* (2013.01); *H05B 47/10* (2020.01)

(58) Field of Classification Search

CPC ..... F21V 21/0885; A42B 3/0446

USPC ..... 362/106

See application file for complete search history.

(56) References Cited

U.S. PATENT DOCUMENTS

| | | | | |
|---|---|---|---|---|
| 1,203,576 | A | 11/1916 | Broadhead | |
| 1,645,487 | A | 10/1927 | Harling | |
| 1,671,744 | A | 5/1928 | Rosenberg | |
| 1,816,065 | A | 7/1931 | Weidman | |
| 2,581,129 | A | 1/1952 | Muldoon | |
| 2,716,700 | A | 8/1955 | La France | |
| 3,003,057 | A | 10/1961 | Cheng | |
| 4,045,663 | A | 8/1977 | Young | |
| 4,135,230 | A | 1/1979 | Armbruster | |
| 5,067,058 | A | 11/1991 | Standley | |
| D353,055 | S | 12/1994 | Kish | |
| 5,558,430 | A | 9/1996 | Booty, Jr. | |
| D378,434 | S | 3/1997 | Petterson | |
| 5,755,644 | A | 5/1998 | Breems | |
| 5,800,045 | A | 9/1998 | Kish | |
| 5,871,272 | A | 2/1999 | Sharrah | |
| D407,514 | S | 3/1999 | Yuen | |
| 6,046,572 | A * | 4/2000 | Matthews | F21L 4/005 320/114 |
| 6,099,141 | A | 8/2000 | Landamia | |

(Continued)

FOREIGN PATENT DOCUMENTS

| | | |
|---|---|---|
| CA | 2544975 | 5/2005 |
| WO | 2017176444 | 10/2017 |

OTHER PUBLICATIONS

Webster's II New College Dictionary, published 1995, Houghton Mifflin Co. p. 559.

(Continued)

*Primary Examiner* — Christopher M Raabe

(74) *Attorney, Agent, or Firm* — Niels Haun; Dann, Dorfman, Herrell & Skillman, P.C.

(57) ABSTRACT

Flashlight having modular mount system with integral mount element on the flashlight body and/or having programmable rear-facing signal lights.

19 Claims, 17 Drawing Sheets

(56) References Cited

U.S. PATENT DOCUMENTS

| | | | | |
|---|---|---|---|---|
| 6,158,874 | A | 12/2000 | Brustein | |
| 6,168,288 | B1 | 1/2001 | St Claire | |
| 6,302,570 | B1 | 10/2001 | Petell | |
| 6,305,818 | B1 | 10/2001 | Lebens | |
| 6,318,879 | B1 | 11/2001 | Huang | |
| 6,331,062 | B1 | 12/2001 | Sinclair | |
| 6,439,733 | B1 | 8/2002 | Fischer | |
| 6,450,659 | B1 | 9/2002 | Salatino | |
| 6,523,972 | B2 | 2/2003 | Sharrah | |
| 6,565,241 | B1 | 5/2003 | Glynn | |
| 7,059,744 | B2 | 6/2006 | Sharrah | |
| 7,172,310 | B2 | 2/2007 | Hsu | |
| 7,188,978 | B2 | 3/2007 | Sharrah | |
| D548,385 | S | 8/2007 | Sharrah | |
| D566,314 | S | 4/2008 | Jen | |
| RE40,342 | E | 5/2008 | Krieger | |
| 7,401,941 | B2 | 7/2008 | Teng | |
| 7,481,551 | B2 | 1/2009 | Sharrah | |
| 7,614,760 | B2 | 11/2009 | Sharrah | |
| D605,795 | S | 12/2009 | Baker | |
| D611,629 | S | 3/2010 | Sharrah | |
| D612,970 | S | 3/2010 | Sharrah | |
| 7,689,491 | B2 | 3/2010 | Coates | |
| 7,731,385 | B2 | 6/2010 | Spartano | |
| 8,287,157 | B2 | 10/2012 | Sharrah | |
| D674,525 | S | 1/2013 | Sharrah | |
| 8,371,729 | B2 | 2/2013 | Sharrah | |
| D681,858 | S | 5/2013 | Sharrah | |
| D685,510 | S | 7/2013 | Henry | |
| D707,869 | S | 6/2014 | Wu | |
| 8,905,573 | B2 | 12/2014 | Sharrah | |
| D728,139 | S | 4/2015 | Wang | |
| D737,487 | S | 8/2015 | Beckett | |
| D740,986 | S | 10/2015 | Hine | |
| D751,742 | S | 3/2016 | Windom | |
| D765,295 | S | 8/2016 | McLennan | |
| D767,187 | S | 9/2016 | Hine | |
| D796,622 | S | 9/2017 | Sharrah | |
| 2002/0149928 | A1 | 10/2002 | Watterson | |
| 2002/0191396 | A1 | 12/2002 | Reiff | |
| 2003/0156407 | A1 | 8/2003 | Galli | |
| 2005/0082989 | A1 | 4/2005 | Jones | |
| 2005/0094388 | A1 | 5/2005 | Booty | |
| 2005/0099804 | A1 | 5/2005 | Sharrah | |
| 2006/0034074 | A1 | 2/2006 | Ko | |
| 2006/0262527 | A1 | 11/2006 | Sharrah | |
| 2007/0171082 | A1* | 7/2007 | Melnik | F21L 4/005 340/574 |
| 2009/0180271 | A1* | 7/2009 | Jachmann | F21L 4/085 362/20 |
| 2009/0190332 | A1 | 7/2009 | Sharrah | |
| 2010/0219775 | A1* | 9/2010 | Maglica | F21L 4/045 315/362 |
| 2010/0277899 | A1 | 11/2010 | Peak | |
| 2012/0092880 | A1* | 4/2012 | Wang | F21V 21/0885 362/396 |
| 2012/0139452 | A1 | 6/2012 | Galli | |
| 2012/0182723 | A1 | 7/2012 | Sharrah | |
| 2014/0092590 | A1 | 4/2014 | Parker | |
| 2014/0240967 | A1* | 8/2014 | Sharrah | F21L 4/08 362/183 |
| 2015/0276347 | A1 | 10/2015 | Sharrah | |
| 2016/0018071 | A1 | 1/2016 | Sharrah | |
| 2017/0284646 | A1 | 10/2017 | Arena | |

OTHER PUBLICATIONS

The "10 Mile Light", Bright Star Product Brochure published before Nov. 7, 2003, 2 pages.

LiteBox, sold prior to Nov. 2003.

Streamlight, "TLR-VIR Product Fact Sheet", Issued Oct. 3, 2008, Revised Apr. 21, 2014, 1 sheet, Document #255.

Streamlight, "TLR-VIR Operating Instructions", ©2012, Rev B Mar. 2012, 8 pages.

Streamlight, "TLR-VIR Tactical Gun Mount", printed Feb. 29, 2016, 2 pages, http://www.streamlight.com/en-au/product.html?pid=198.

Streamlight, "Vantage Product Fact Sheet", Issued Apr. 4, 2008, Revised Jul. 1, 2014, 1 sheet, Document #249.

Streamlight, "Vantage Operating Instructions", Rev D Jul. 2013, 20 pages.

Streamlight, "Vantage Helmet Mount", printed Feb. 29, 2016, 2 pages, http://www. stream l ight.com/it-it/p rod uct/prod uct. html ?pid = 1 94.

Streamlight, "Fire Vulcan—Rechargeable Lantern Product Specifications and Product Fact Sheet", Issued Oct. 1, 2004, Revised Dec. 23, 2016, Document #14 0, 3 pages.

Streamlight, "Fire Vulcan LED—Rechargeable Lantern Product Specifications and Product Fact Sheet", Issued Apr. 7, 2008, Revised Dec. 23, 2016, Document #241, 3 pages.

International Searching Authority, "Notification of Transmittal of the International Search Report and the Written Opinion for International Application No. PCT/US17/23171 ", dated Aug. 2, 2017, 18 pages.

* cited by examiner

FLASHLIGHT WITH REAR-FACING SIGNAL LIGHT AND MODULAR INTEGRATED MOUNT SYSTEM

FIELD OF THE INVENTION

The present invention relates generally to flashlights, and more particularly, but not exclusively, to flashlights configured for mounting to a helmet via a modular mount system and to flashlights having programmable rear-facing signal lights.

BACKGROUND OF THE INVENTION

First responders and other professionals often find themselves in environments where sufficient illumination is not available and resort to the use of a flashlight to provide necessary illumination. Such environments may include smoke or naturally occurring impediments to visibility, making it both difficult for individuals to see and to be seen by others. Enhancing the visibility of the flashlight user can be particularly important in such situations, because first responders often work in hazardous environments of low visibility, and not only need to see their surroundings, but also need to make their location known to fellow responders. In addition, the use of both hands can often be essential, making the holding of a flashlight inconvenient or impossible. Accordingly, Applicant has recognized that individuals, such as first responders and other professionals, have a need for flashlights which can simultaneously provide hands-free use and indicate their location to others.

SUMMARY OF THE INVENTION

As a result, Applicant has conceived of, and created, a flashlight which includes programmable rear-facing signal lights to indicate user position and/or a modular mount system to enable mounting of the flashlight on a variety of helmets. Thus, in one of its aspects, flashlights of the present invention may include a forward-facing illumination source at the front of the flashlight to provide a beam of light suitable for illuminating a scene for the user. (As used herein the term "front" is defined to mean the end of the flashlight containing the forward-facing illumination source.) At an opposing rear end of the flashlight one or more rear-facing signal lights may be provided, and the signal lights may be programmed to illuminate according to one or more selectable, preprogrammed patterns. (As used herein, the term "rear" is defined to refer to an end of the flashlight opposing the front end; and "rear-facing" is defined to mean in a direction away from the rear end of the flashlight.)

In this regard, the present invention may provide a flashlight comprising a body having a cavity disposed therein configured to receive one or more batteries, the body having a front end and an opposing rear end. A forward-facing illumination source may be disposed at the front end of the body and configured to provide a beam of light to illuminate an area in front of the light source. A circuit board may be disposed within the body with one or more rear-facing signal lights, such as LEDs, electrically connected thereto at an orientation to provide light at the rear end of the flashlight. The flashlight may also include a flexible translucent boot disposed within the body between the circuit board and the rear end of the body, the boot having one or more windows each of which may extend outwardly through a respective opening at the rear end of the body. Each boot window may be disposed in registration with a respective one of the one or more rear-facing signal lights. The circuit board may include a switch, and the flexible translucent boot a push-button region disposed in registration with the switch. The circuit board may include control circuitry configured to control the one or more rear-facing signal lights.

In another of its aspects, the present invention provides flashlights having a modular mounting system configured to permit the flashlight to be mounted to a variety of helmets. The mounting system may include a mounting feature provided on the flashlight body, such as a mounting slot, to receive a helmet mount. A variety of different helmet mounts may be provided any one of which may be attached to the mounting feature of the flashlight. In this way, a specific helmet mount may be selected based on the type of helmet to which the flashlight is to be attached, providing a modular approach to flashlight mounting.

As such, the flashlight may include the aforementioned body, optionally with the one or more rear-facing signal lights, and may include a mount feature integrally formed on the body to provide a single unitary structure incorporating the mount feature with the body, which may be configured to slideably receive a selected one of a plurality of helmet mounts having a mounting base with a shape that is complementary to the shape of the mount feature. In addition, the flashlight may be provided as part of a flashlight system that includes, in combination with the flashlight, at least one helmet mount having a mounting base with a shape that may be configured to be slideably disposed in the mount feature, which may be a recess. The mount feature may also include a longitudinal axis oriented perpendicular to a longitudinal axis extending along the length of the cavity of the body. The at least one helmet mount may include a plurality of helmet mounts each having an identically shaped mounting base and each having a different upper mounting structure from one another for securing the flashlight to a helmet. For example, the upper mounting structure of a first one of the plurality of helmet mounts may include a clamp and the upper mounting structure of a second one of the plurality of helmet mounts may include a mounting tab. Thus, the present invention may provide a collection of helmet mounts in combination with a flashlight body to provide a flashlight system with interchangeable helmet mounts.

BRIEF DESCRIPTION OF THE DRAWINGS

The foregoing summary and the following detailed description of exemplary embodiments of the present invention may be further understood when read in conjunction with the appended drawings, in which.

DETAILED DESCRIPTION OF THE INVENTION

Figure 1A:
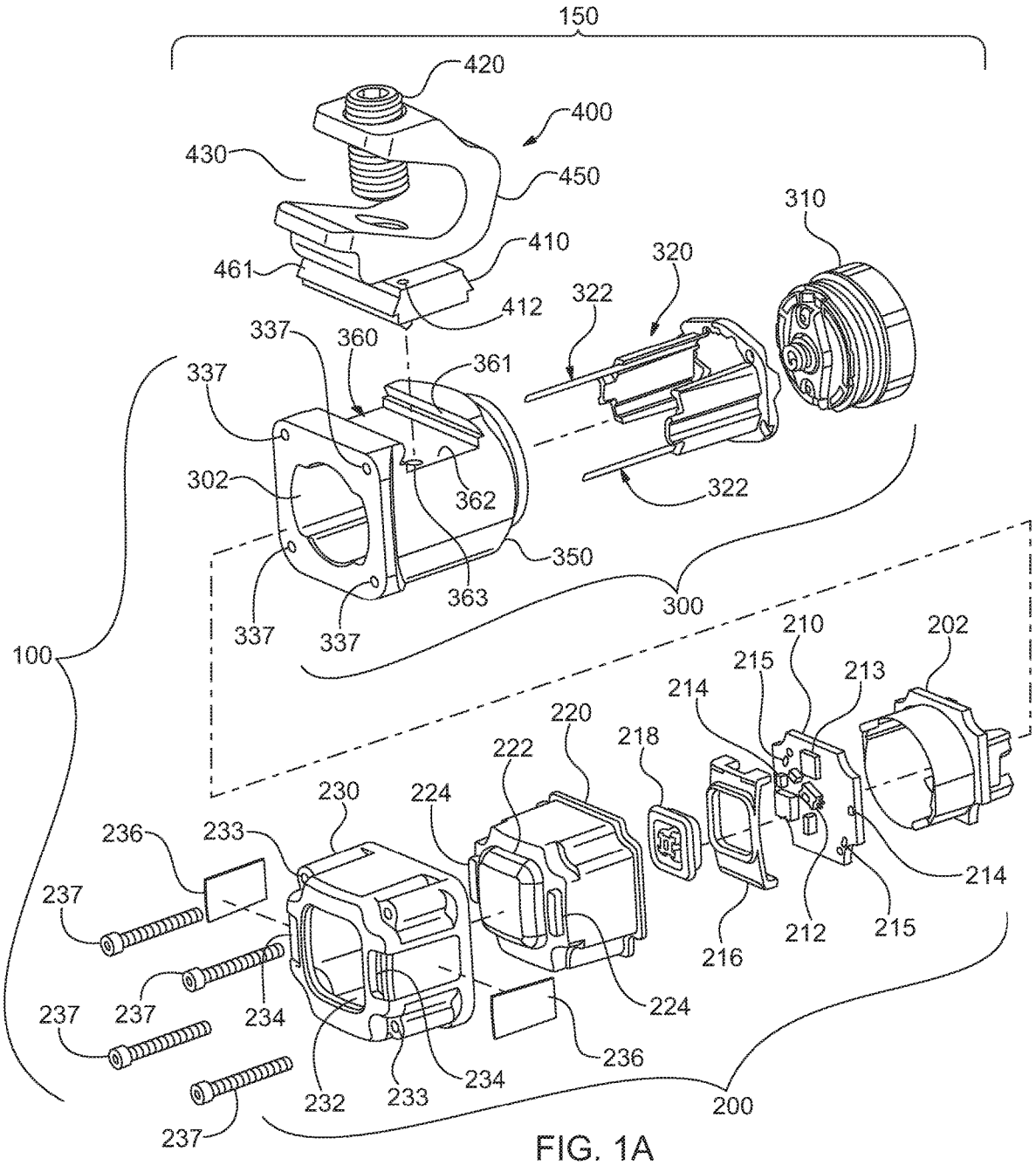
FIG. 1A schematically illustrates an exploded view of an exemplary configuration of a flashlight in accordance with the present invention, having a mounting element in the form of a slot integrally formed in the body of the flashlight, and having rear-facing signal lights that may be programmed to illuminate according to one or more specified flashing patterns.
Figure 1B:
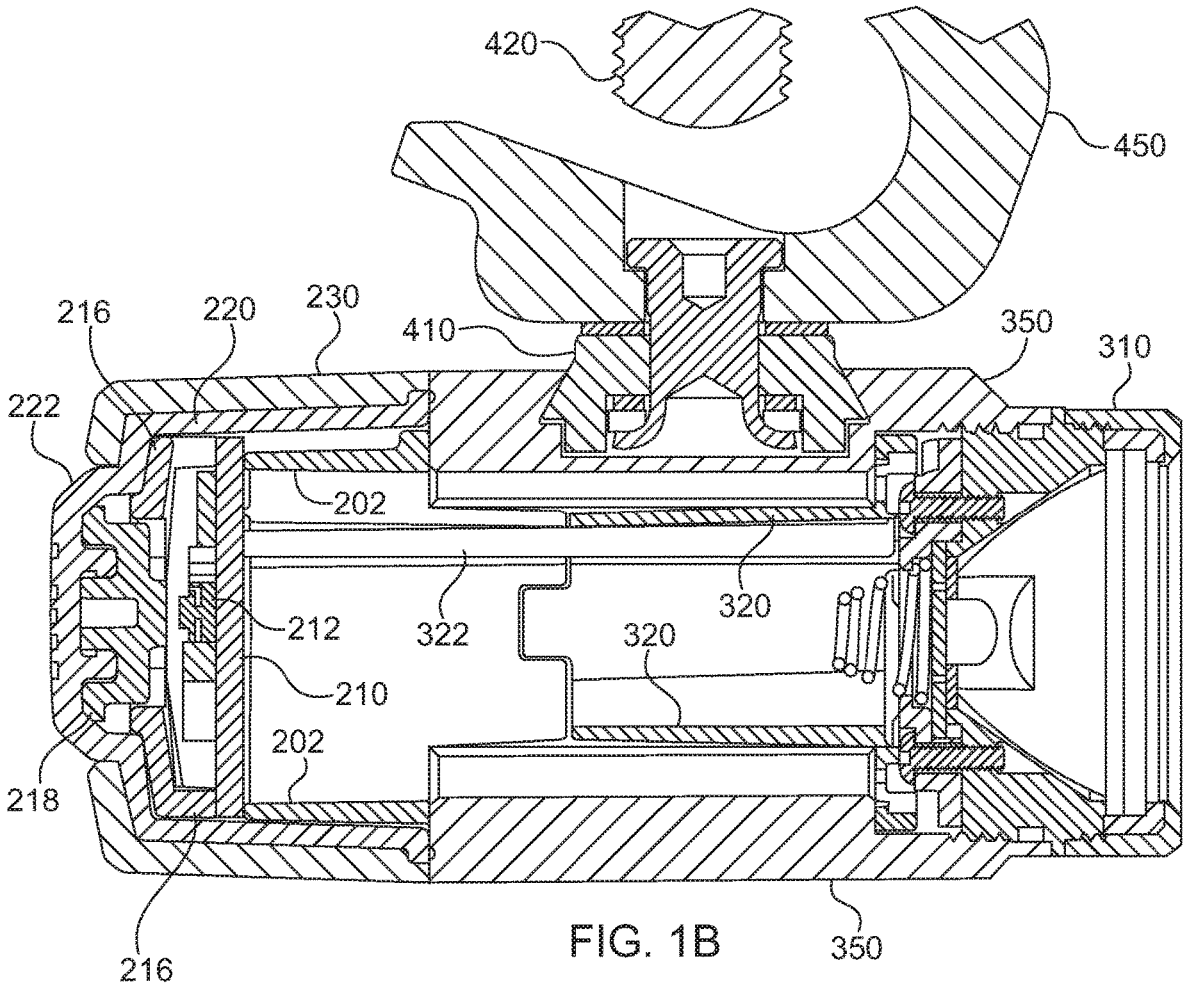
FIG. 1B schematically illustrates a side elevational view in cross section of the assembled flashlight of FIG. 1A.
Figure 1C:
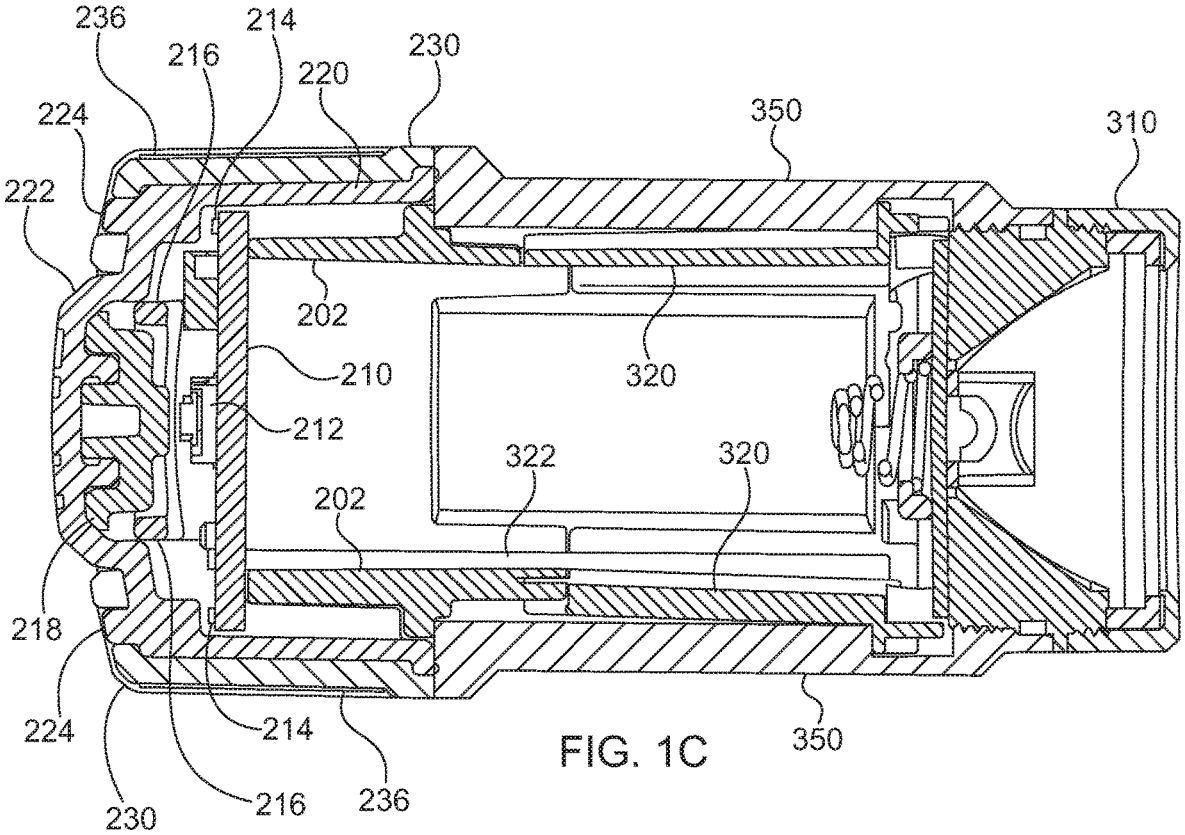
FIG. 1C schematically illustrates a top view in cross section of the assembled flashlight of FIG. 1A.
Figure 2:
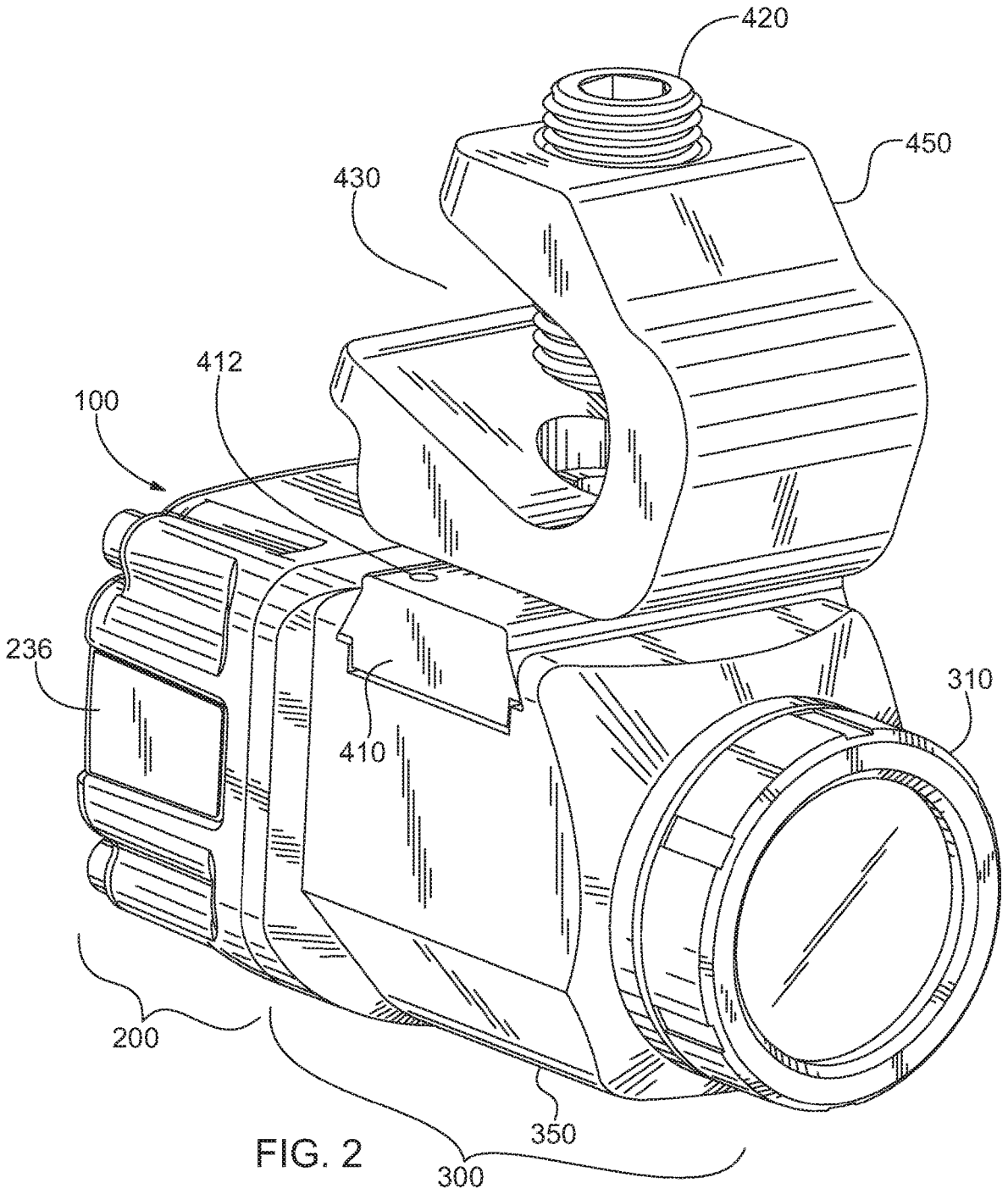
FIG. 2 schematically illustrates an isometric view of the flashlight of FIG. 1A from the front of the flashlight.

Referring now to the figures, wherein like elements are numbered alike throughout, FIGS. 1A-1C schematically illustrate exploded and cross-sectional views of an exemplary configuration a flashlight system 150 in accordance with the present invention. The flashlight system 150 is configured to provide hands-free operation, along with both forward-facing illumination and rear-facing signal lighting. Regarding the hands-free operation, the flashlight system 150 may include a flashlight 100 and a separate helmet mount 400 which may be configured to be slideably received by a mounting feature, such as a mounting slot 360, integrally formed in the flashlight body 350. In addition, a pair of rear-facing light sources, such as LEDs 214, may provide signaling light through translucent LED windows 224 at the rear of the flashlight 100, FIGS. 1A, 1B, 3.

Turning to the flashlight 100 in more detail, the flashlight 100 may include a facecap module 310, which includes a light source, such as a bulb or LED, for illuminating a scene along with suitable optics, such as a reflector, to assist in delivering the forward illumination from the facecap module 310, FIGS. 1A-1C. The facecap module 310 may be retained in the flashlight body 350 in an opening thereof by complementary mating threads on each of the flashlight body 350 and facecap module 310 to provide a body assembly 300. A contact retainer 320 having contact straps 322 may be disposed within a cavity 302 of the flashlight body 350. A tailcap frame 202 may be disposed within the cavity 302 of the body 350 at an opposing end of the body 350 to the end in which the contact retainer 320 is located. A printed circuit board support 216 may be provided to support a printed circuit board 210 in contact with the tailcap frame 202. The contact straps 322 may extend through the body 350 and tailcap frame 202 to be received by through-holes 215 in the circuit board 210, where the straps 322 may be soldered in place to provide electrical connection between the circuit board 210 and the facecap module 310 via the contact retainer 320, FIG. 1B.

The circuit board 210 may include one or more rear-facing LEDs 214, or other suitable light source, and a switch 212 through which the LEDs 214 and the light source of the facecap module 310 may be actuated. In this regard, the switch 212 may be electrically connected to control circuitry 213 which may comprise one or more integrated or discrete elements, FIG. 1A. For example, the control circuitry 213 may include a processor model PIC16F1704 (Microchip Technology Inc., Chandler, Ariz.), along with a boost regulator model TPS61021 and current sense amplifier INA199B1 (Texas Instruments Inc., Dallas, Tex.). Other examples of electrical and/or control circuitry having aspects applicable to exemplary flashlights 100 of the present invention may be found in U.S. Pat. No. 7,466,082 entitled "Electronic Circuit Reducing and Boosting Voltage for Controlling LED Current," U.S. Pat. No. 8,662,701 entitled "Flashlight Having a Controller Providing Programmable Operating States," and U.S. Pat. No. 8,779,683 entitled "Light Having A Circuit Accommodating Batteries of Different Types and/or Sizes," each of which is hereby incorporated herein by reference in its entirety, for any purpose.

A transparent or translucent flexible boot 220 may be provided over the circuit board 210 and at least a portion of the tailcap frame 202 to butt up against the rear end of the flashlight body 350. The boot 220 may be attached using an adhesive, or other suitable material and method, to the flashlight body 350 to provide a water-tight or air-tight seal to the body 350, FIGS. 1B, 1C. Thus, internal flashlight components, such as the circuit board 210 and control circuitry 213, may be protected by the boot 220 from the entry of dust, the elements, or other unwanted materials.

The boot 220 may include an outwardly projecting pushbutton cap 222, which may be pressed by a user to actuate the switch 212. To transfer motion of the pushbutton cap 222 to the switch 212, a rigid actuator 218 may be disposed between the pushbutton cap 222 and the switch 212. The outwardly projecting pushbutton cap 222 may be configured to be resilient so that it springs back to an original position after the user depresses it to actuate the switch 212. In this regard, both the shape of the pushbutton cap 222 and the material of the flexible boot 220 may be selected to achieve this effect.

Figure 3:
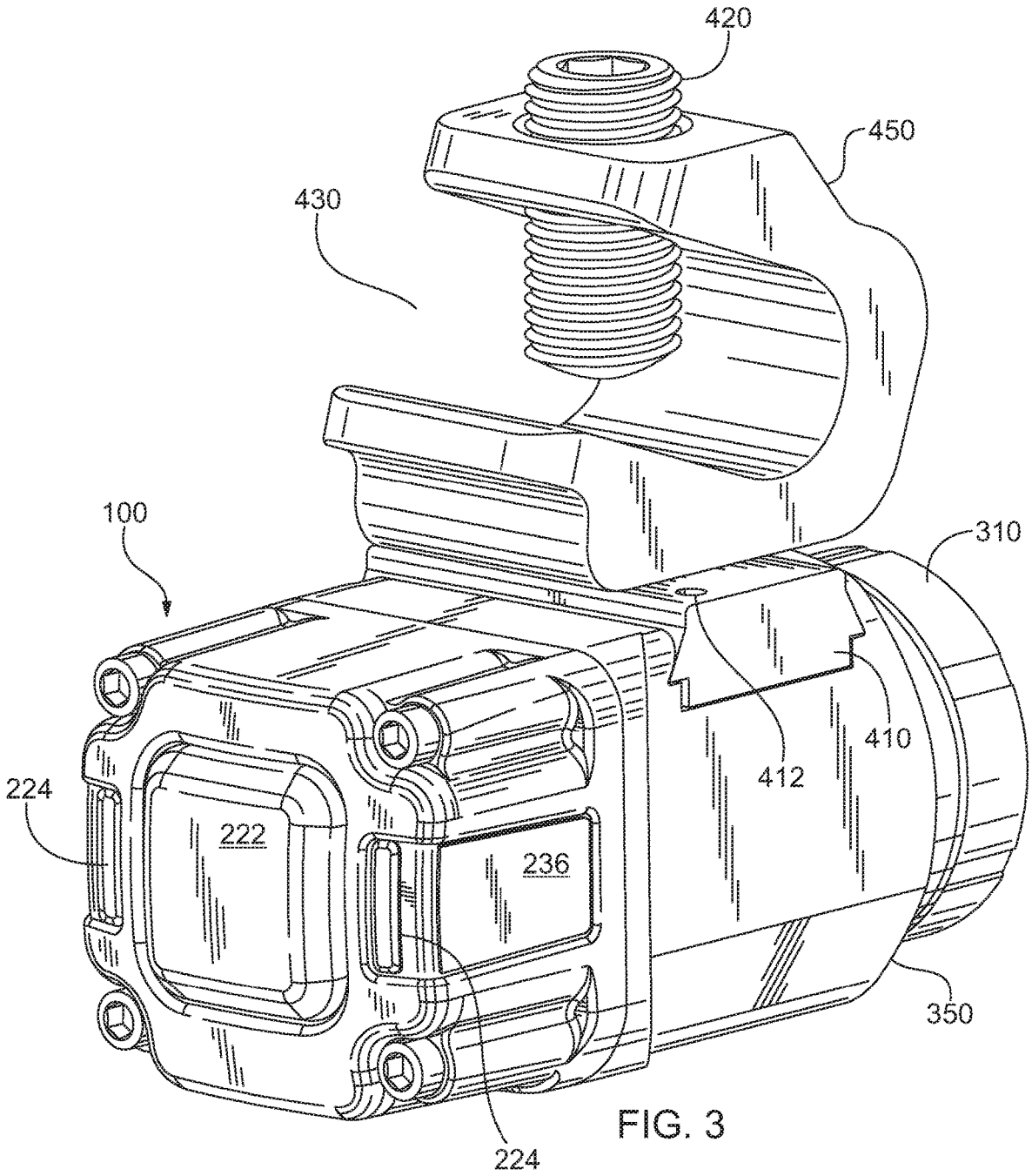
FIG. 3 schematically illustrates an isometric view of the flashlight of FIG. 1A from the rear of the flashlight.
Figure 4:
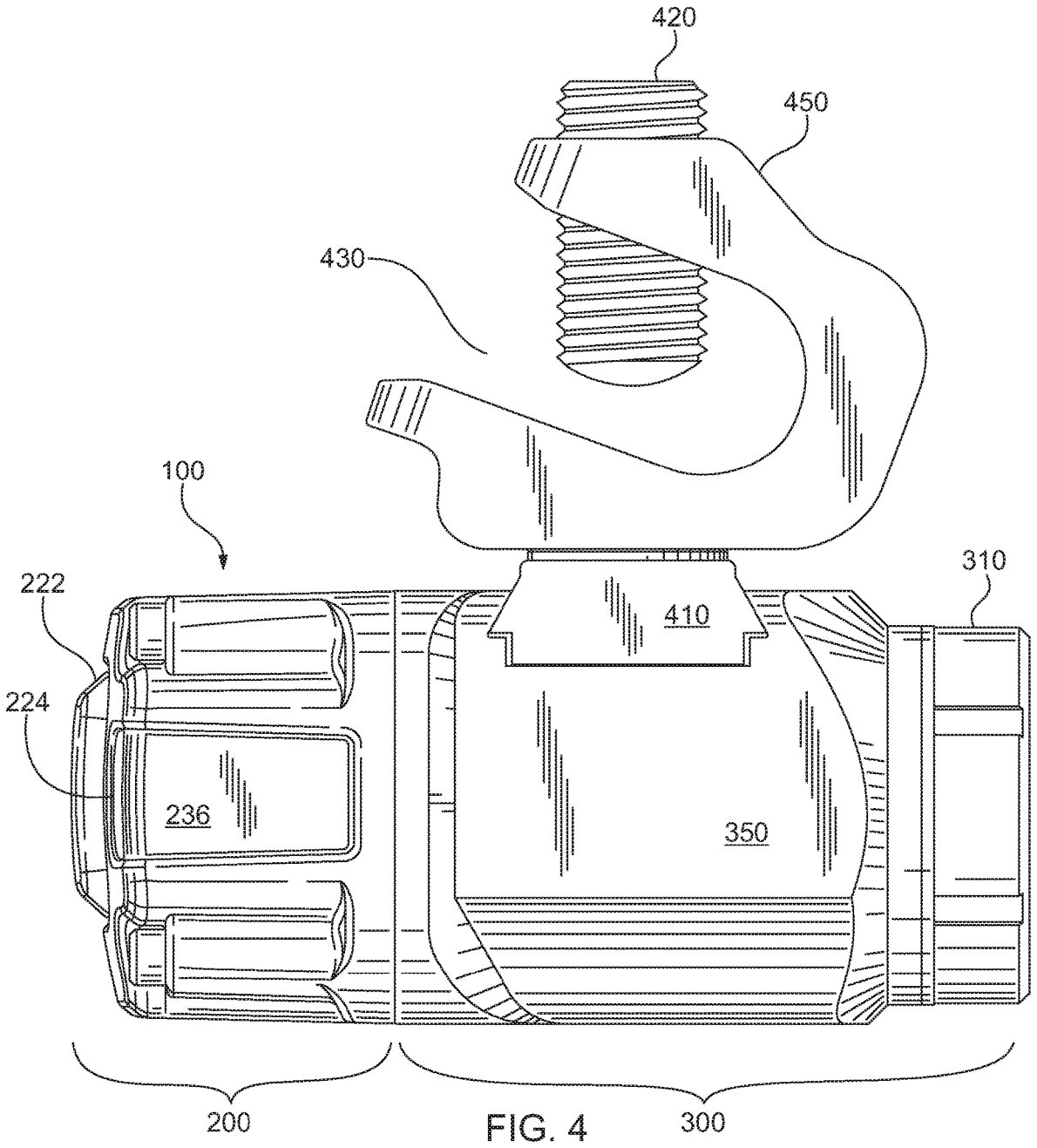
FIG. 4 schematically illustrates a side elevational view of the flashlight of FIG. 1A.
Figure 5:
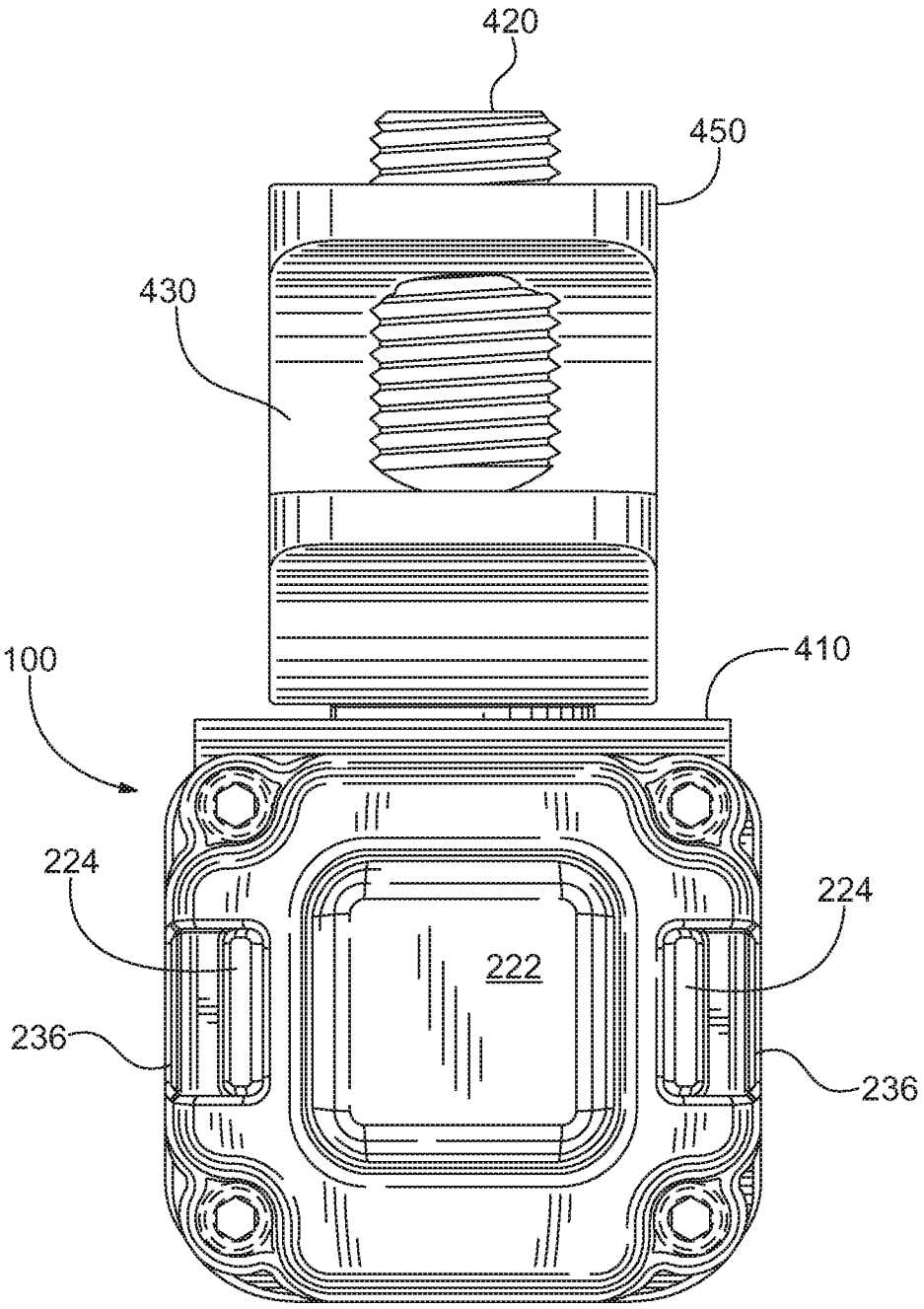
FIG. 5 schematically illustrates the rear view of the flashlight of FIG. 1A.
Figure 6:
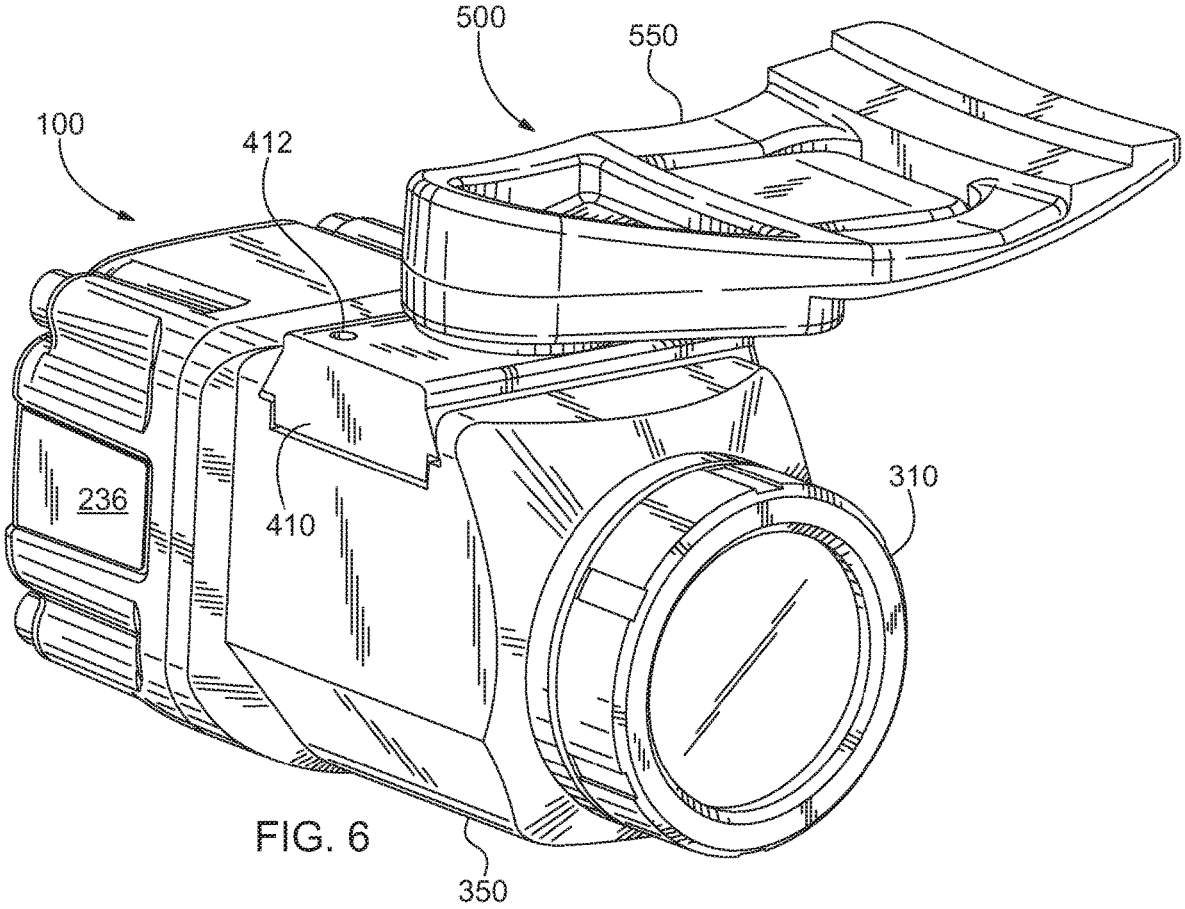
FIG. 6 schematically illustrates an isometric view of the front of the flashlight of FIG. 1A, but having an alternative helmet mount disposed in the slot.
Figure 7:
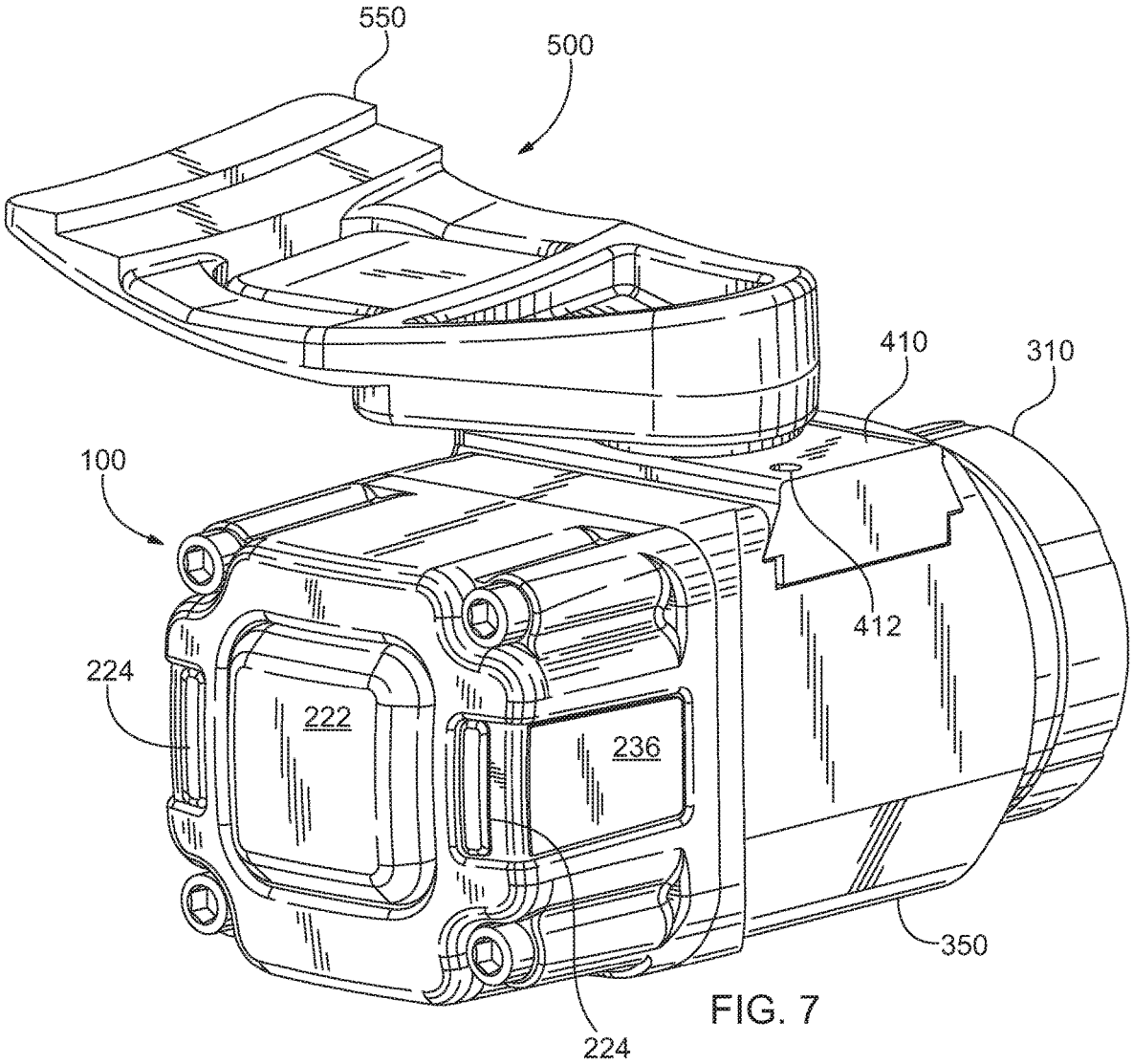
FIG. 7 schematically illustrates an isometric view of the rear of the flashlight of FIG. 6.
Figure 8:
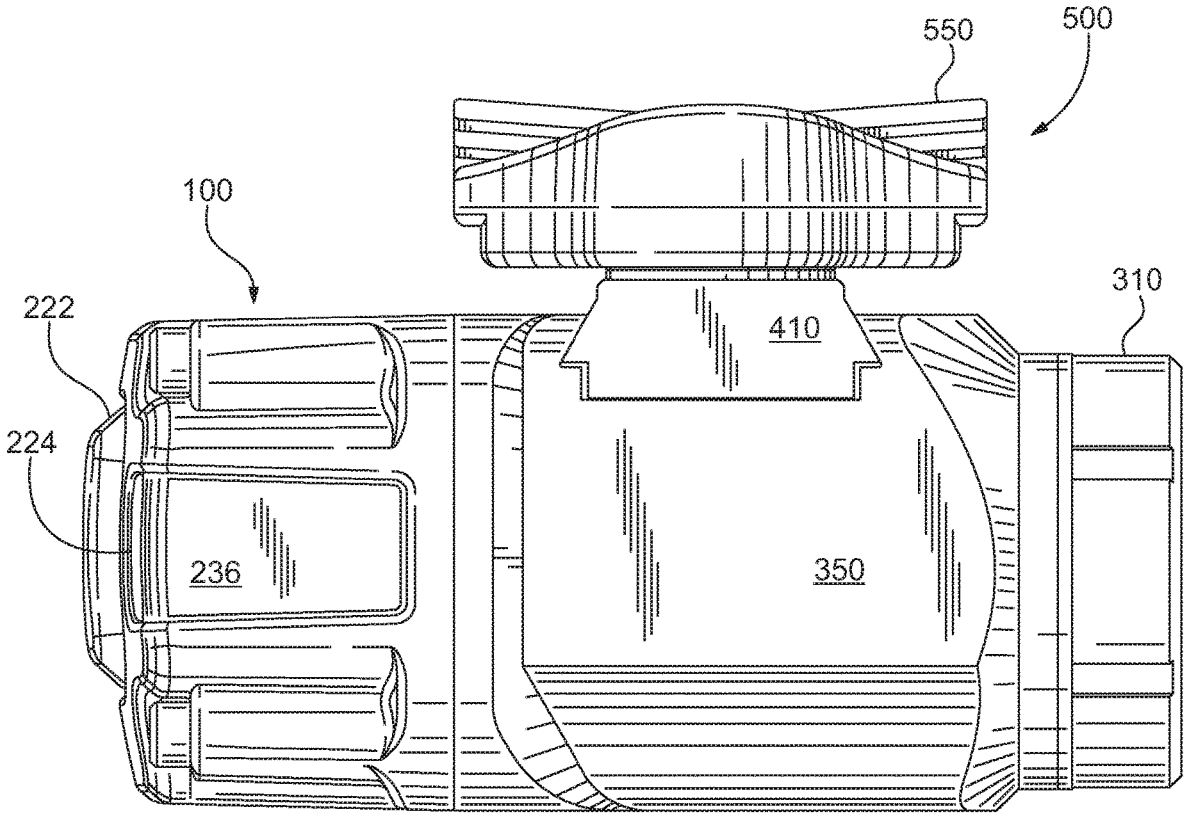
FIG. 8 schematically illustrates a side elevational view of the flashlight of FIG. 6.
Figure 9:
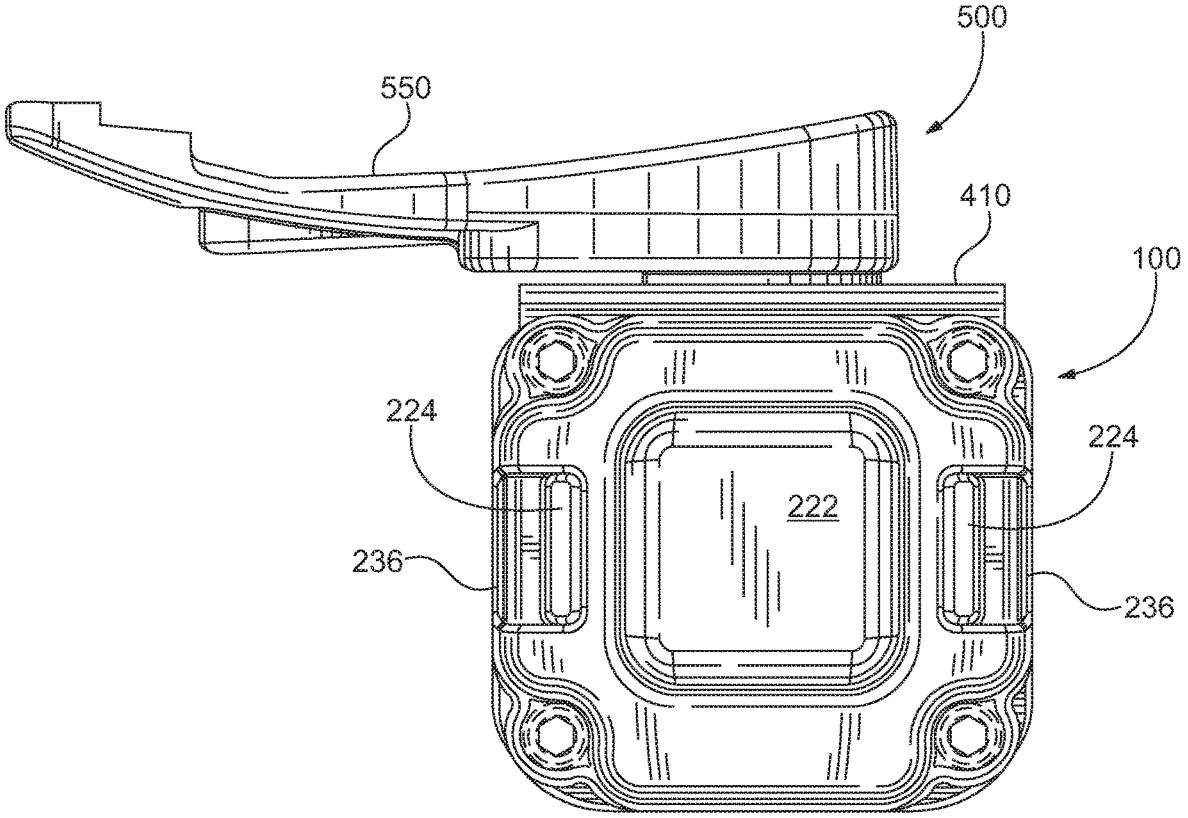
FIG. 9 schematically illustrates a rear view of the flashlight of FIG. 6.
Figure 10:
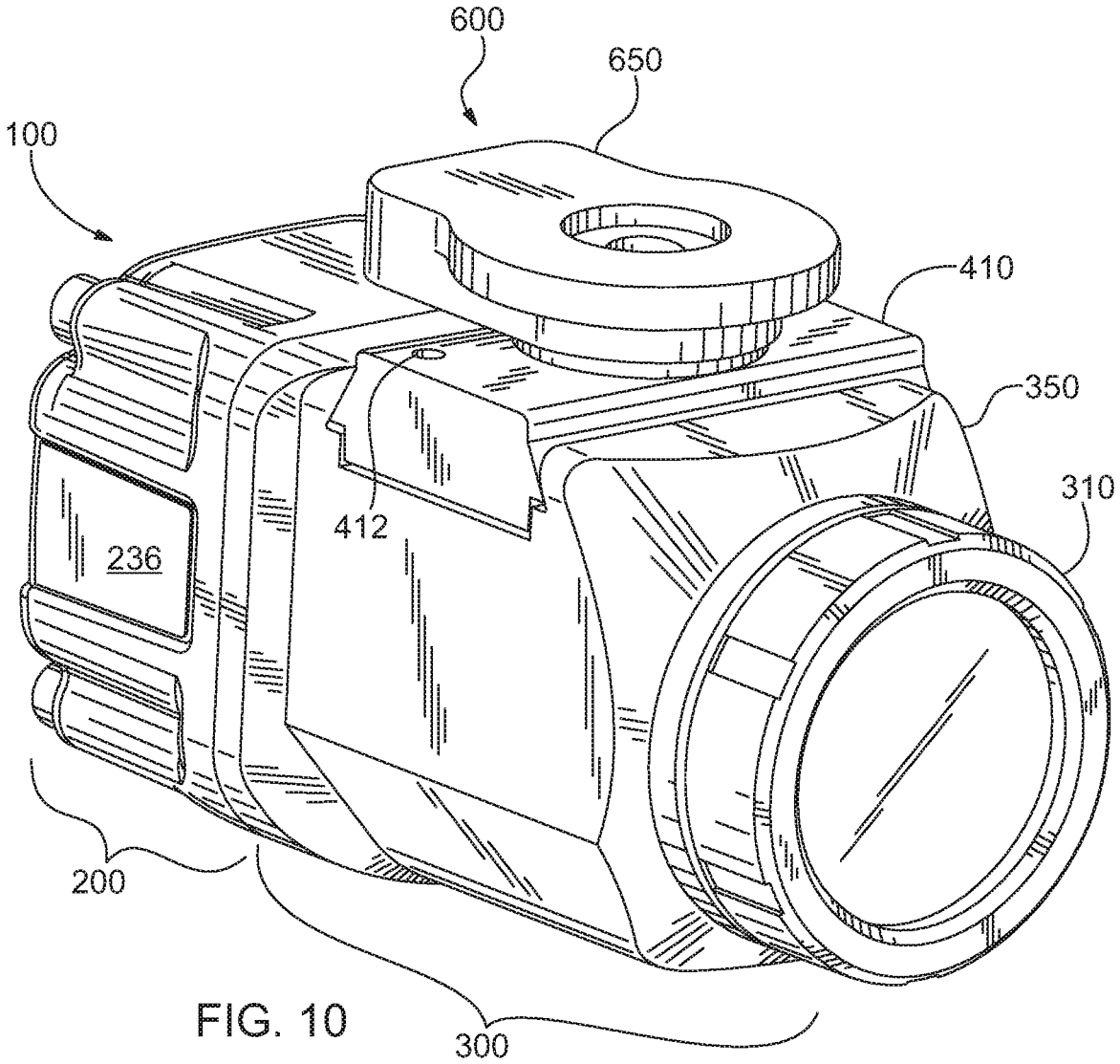
FIG. 10 schematically illustrates an isometric view of the front of the flashlight of FIG. 1A, but having a yet further alternative helmet mount disposed in the slot.
Figure 11:
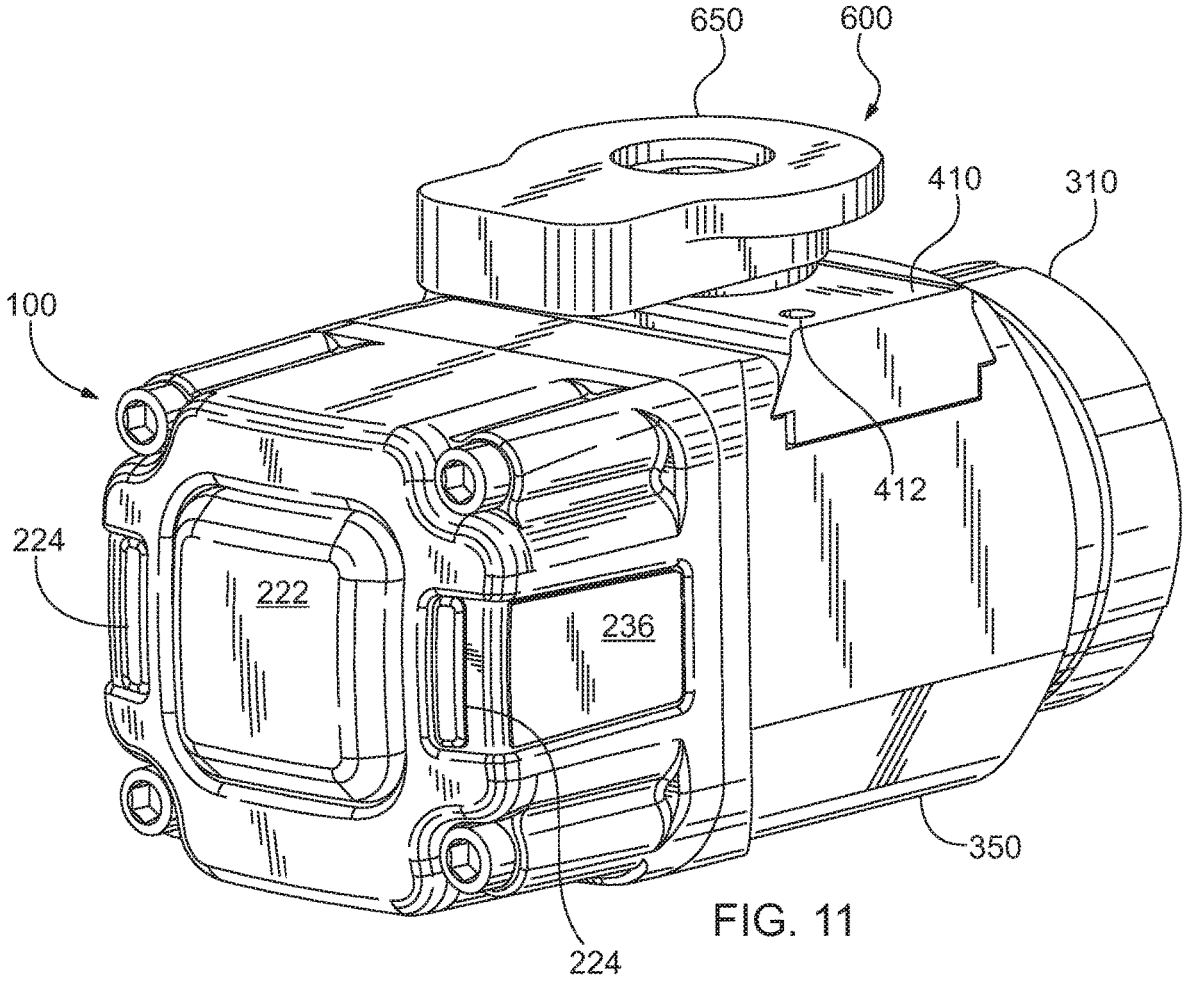
FIG. 11 schematically illustrates an isometric view of the rear of the flashlight of FIG. 10.
Figure 12:
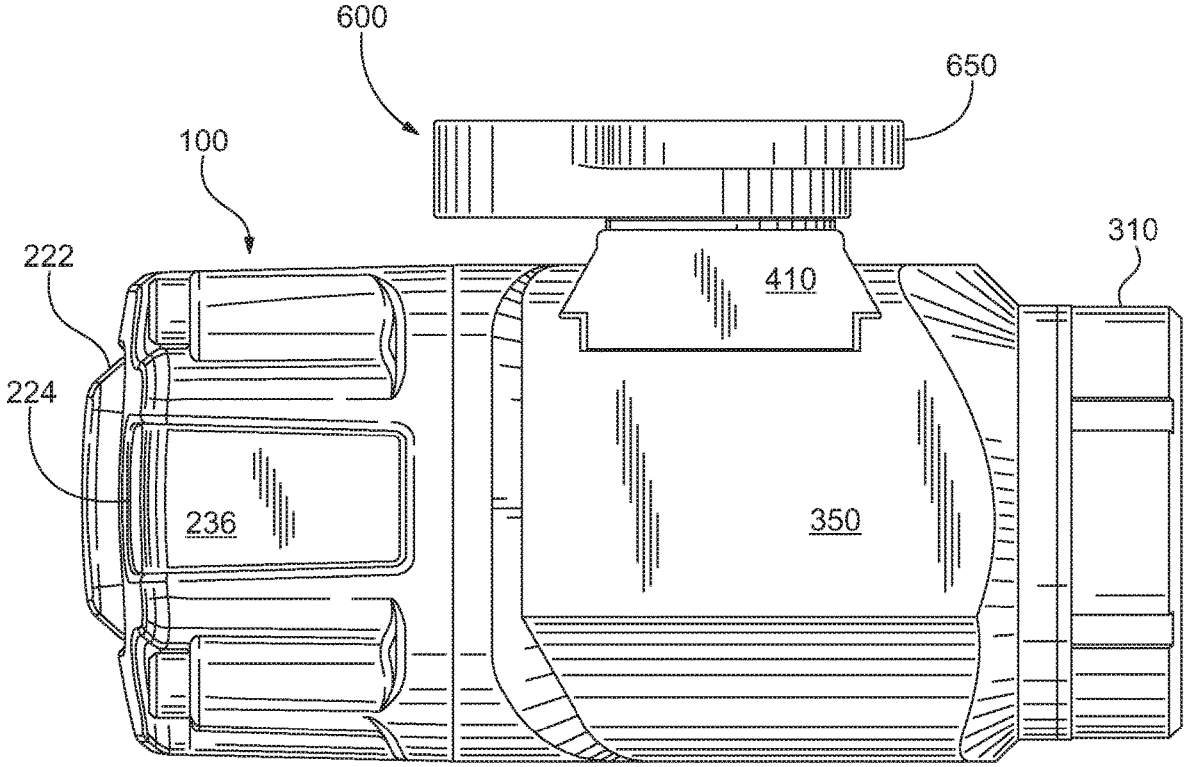
FIG. 12 schematically illustrates a side elevational view of the flashlight of FIG. 10.
Figure 13:
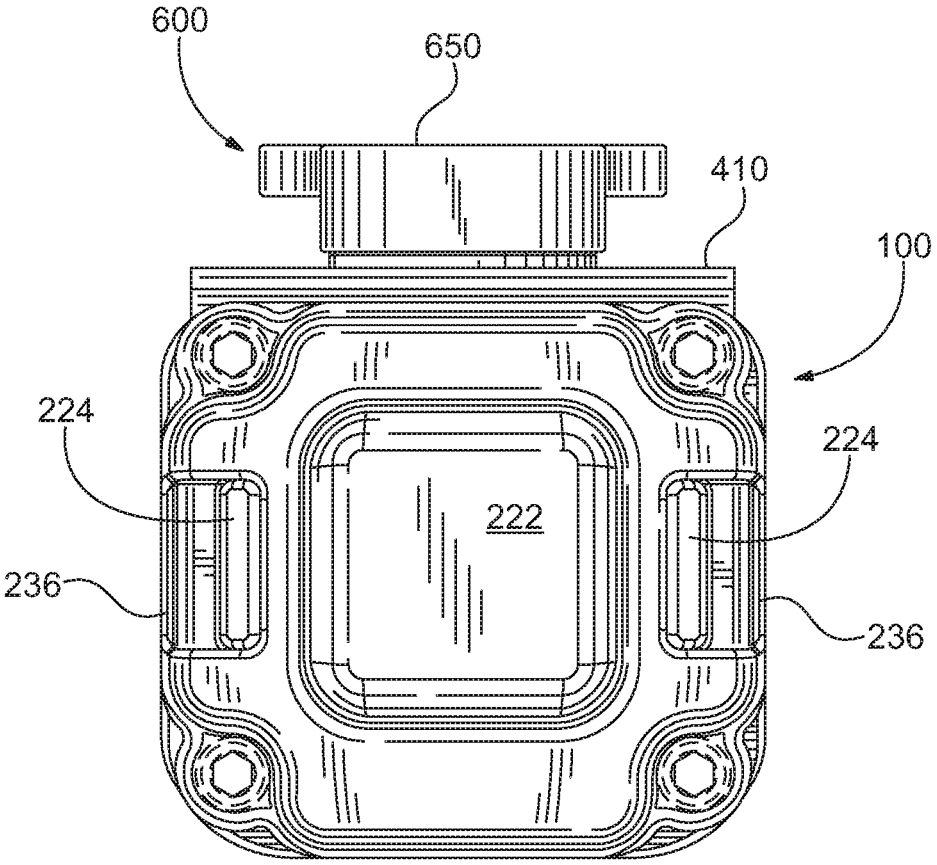
FIG. 13 schematically illustrates a rear view of the flashlight of FIG. 10.
Figure 14:
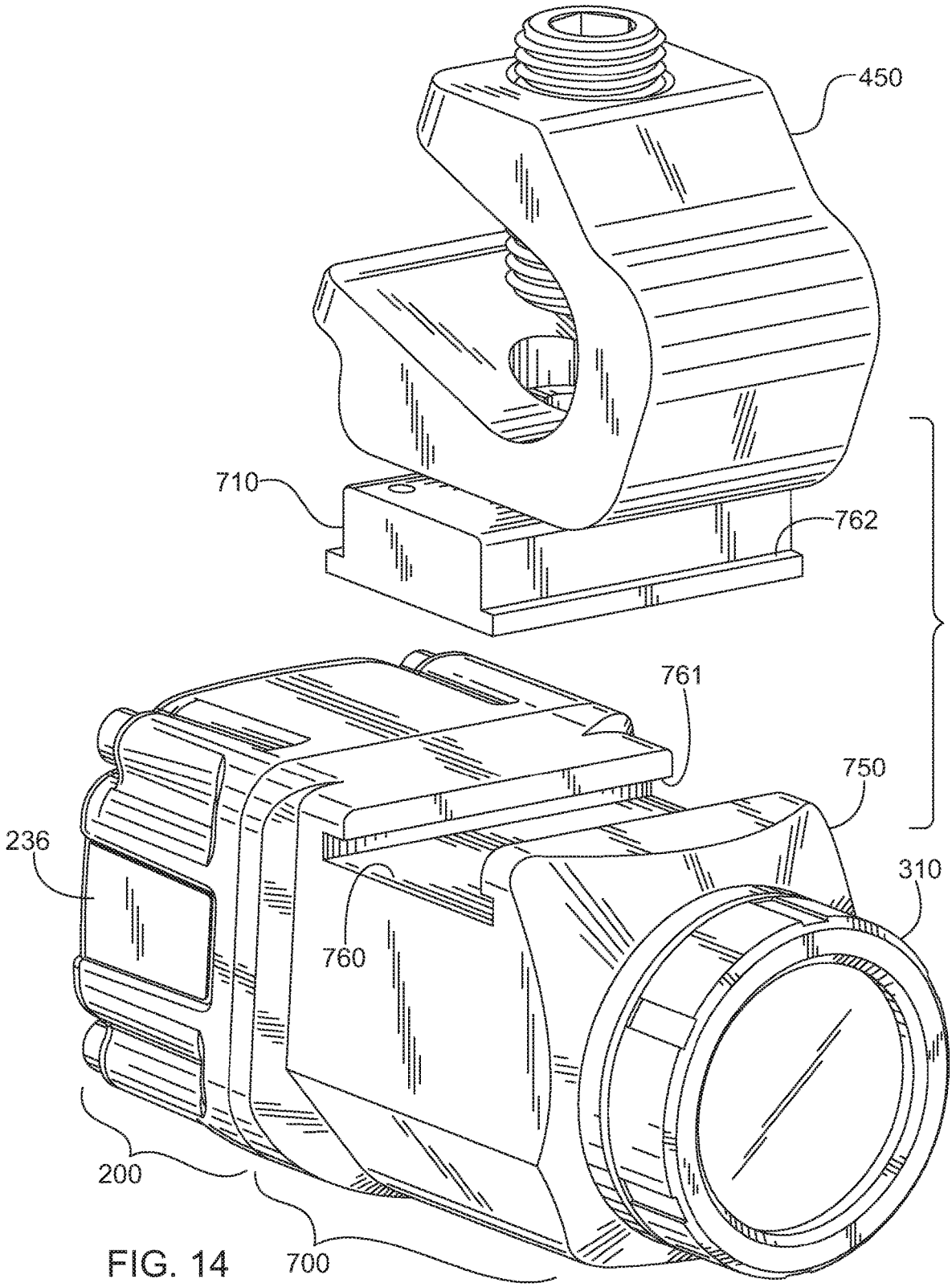
FIG. 14 schematically illustrates an isometric view of a further exemplary configuration of a flashlight in accordance with the present invention similar to that of FIG. 1A but having a differently shaped mounting slot.

In addition, one or more translucent or transparent LED windows 224 may be provided on the boot 220 at locations in registration with the rear LEDs 214 of the circuit board 210, FIGS. 1C, 3, 5, to transmit light from the LEDs 214 therethrough. The windows 224 may be formed as an integral portion of the boot 220 along with the pushbutton cap 222 to form a single, unitary boot structure. In addition, the translucent or transparent pushbutton cap 222 may also receive and transmit light therethrough from the rear LEDs 214. The windows 224 and/or the pushbutton cap 222 may be configured to redirect light from the LEDs 214 by refraction, diffraction, holographically, or any combination thereof. For example, the windows 224 and/or the pushbutton cap 222 may include curved surfaces that provide positive or negative optical power to the windows 224 creating a lens effect. Additionally or alternatively, a diffraction pattern may be provided on the windows 224 and/or the pushbutton cap 222, such as a Fresnel lens, to redirect the light from the LEDs 214. The windows 224 may be provided in the form of projections extending outwardly away from the flashlight body 350, or may be provided as projections extending inwardly towards the flashlight body 350.

A tailcap 230 may be provided over the boot 220 and may mount to a rear surface of the flashlight body 350. A central opening may be provided in the tailcap 230 through which the pushbutton cap 222 of the boot extends, FIGS. 1B, 1C, 3. Similarly, window openings may be provided in the tailcap 230 through which the windows 224 may extend. Holes 233, 337 may be provided in registration to one another in each of the tailcap 230 and body 354, respectively, to receive screws 237 to attach the tailcap 230 to the flashlight body 350, FIG. 1A. The flashlight components, beginning at the front end with the facecap module 310 through and including the tailcap 230, may be disposed along a single longitudinal axis of the flashlight 100. Once assembled, the body assembly 300 in combination with the tailcap 230 provides the overall external structure of the flashlight 100 in which the other components are sealingly contained, FIGS. 1B-4. One or more energy sources, such as batteries, may be retained in the cavity 302, with a first end of the battery(s) disposed in electrical communication with the facecap module 310 and an opposing second end disposed in electrical communication with the circuit board 210. In addition, reflectors 236 may be provided on the flashlight 100, such as on the tailcap 230, for enhanced visibility.

As to the operation of the rear-facing LEDs 214, the control circuitry 213 may be configured to enter a program mode when the user presses and holds the pushbutton cap 222 for 5 seconds. After the initial 5 seconds, the rear-facing LED mode may cycle every 2 seconds between the modes "on," "off," or "flashing," for example. The user may release the pushbutton cap 222 when the desired mode is reached.

In a further of its aspects, the present invention may provide a variety of helmet mounts 400, 500, 600, one portion of which may be slideably attached to the flashlight body 350 and another portion attached to a helmet to provide hands-free operation, FIGS. 2-15. The mounts 400, 500, 600, may include a mount base 410 having a shape that is complementary to, and configured to be received by, the mount slot 360 on the flashlight body 350, FIGS. 1A-13. The mount slot 360 may have a longitudinal axis that is perpendicular to the longitudinal axis of the flashlight 100 and may extend the entire width of the flashlight body 350, FIG. 1A. The mount slot 360 may have a uniform cross-sectional shape in a plane perpendicular to the longitudinal axis thereof, allowing the mount base 410 to slide along the length of the mount slot 360. The mount slot 360 may include a flat base portion 362, or any other suitable shape.

To secure the mount base 410 in the mount slot 360, the mount slot 360 may include a shoulder surface 361 which is sloped inward towards the center of the slot 360 providing a cross-sectional shape to the slot 360 resembling a dovetail. The mount base 410 may include a complementary shoulder surface 461 which abuts the shoulder surface 361 of the mount slot 360. A set screw 412 may be provided in the mount base 410 and may be screwed into a hole 363 in the flat base portion 362 to secure the mount base 410 in the mount slot 360. Alternatively, the set screw 412 may press against the flat base portion 362 exerting a lateral upward force on the mount base 410 away from the base portion 362 to cause the shoulder surfaces 361, 461 to be urged against one another and immobilized by friction therebetween.

While the mounts 400, 500, 600 may all have the same mount base 410 to permit attachment to the same flashlight body 350, the mounts 400, 500, 600 may include differently shaped helmet mounting structures 450, 550, 650. For example, in one exemplary configuration, the helmet mounting structure 450 may be generally C-shaped clamp having an opening 430 disposed therein suitable for attachment to the brim of the helmet, such as a firemen's helmet FIGS. 1A-5. As a further example, the helmet mounting structure may be provided in the form of a locking tab 550 suitable for attachment to an accessory slot of a hard hat, FIGS. 6-9. Alternatively, the helmet mounting structure may be provided in the form of a tab 650, FIGS. 10-13, configured to be inserted into the slot of a gallet helmet. Thus, in one of its aspects the present invention may provide a set of mounts 400, 500, 600 any one of which may be selected and attached to the flashlight body 350 via the mounting feature 360.

In addition, other forms and shapes of the mounting feature 360 may be provided. For example, while the slot 360 is illustrated as being provided on the flashlight body 350, the slot 360 could be provided on the mount base 410, in which case a complementary positive/male mounting feature could be integrally provided on the flashlight body 350 to provide a positive/male unitary structure. Moreover, the cross-section of the mounting feature could have a shape other than dovetail, such as a T-shaped slot 760, which may be integrally formed in a flashlight body 750, FIG. 14. The T-shaped slot 716 may include a shoulder surface 761 extending inward towards the center of the slot 760, and a mount base 710 may have a corresponding shoulder surface 762, which shoulder surfaces 761, 762 may be urged against one another by a set screw to immobilize the mount base 710 in the mount slot 760.

Figure 15:
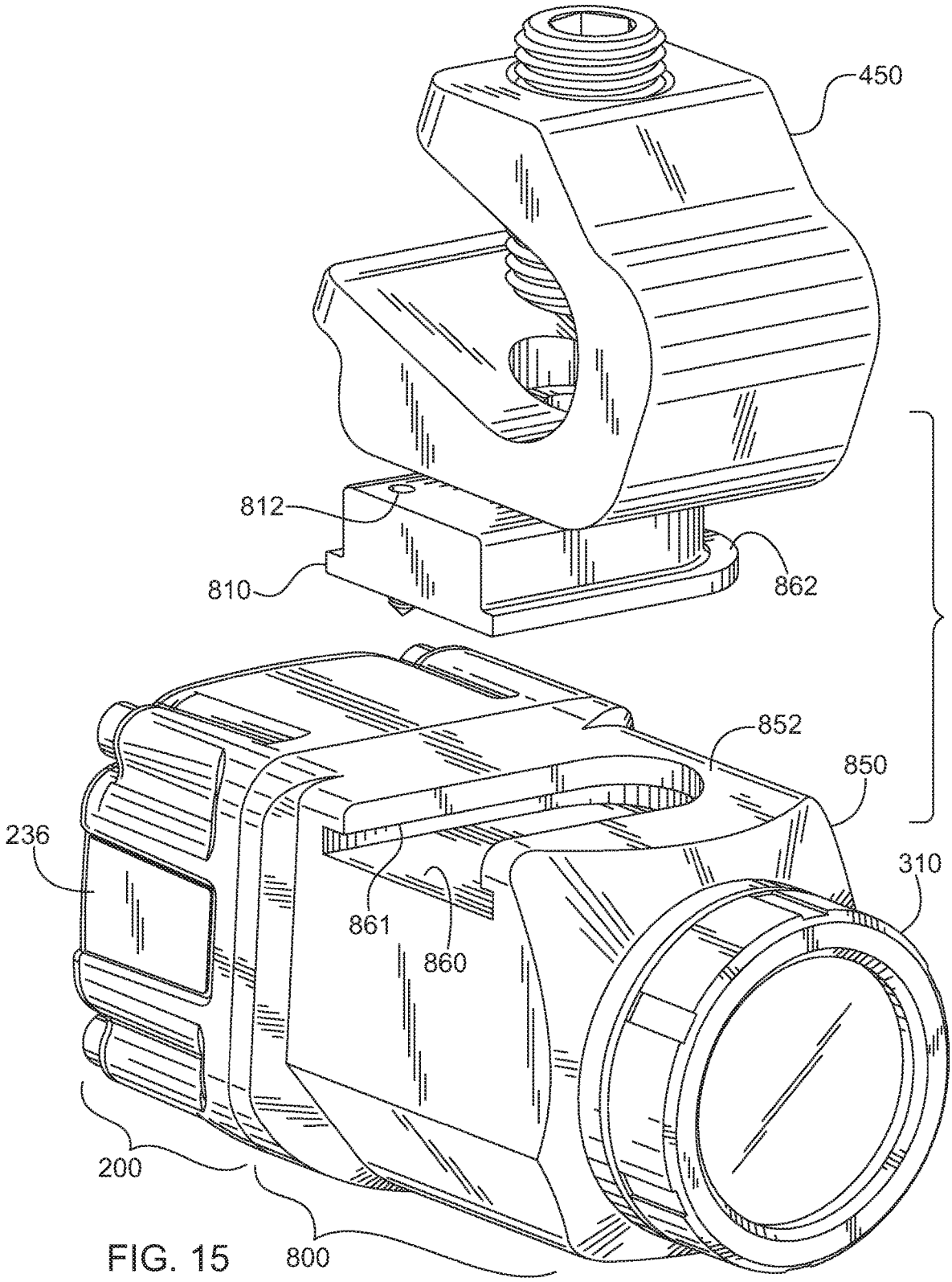
FIG. 15 schematically illustrates an isometric view of a yet further exemplary configuration of a flashlight in accordance with the present invention similar to that of FIGS. 1, 14 but having a differently shaped mounting slot.

Further, the mounting feature 360 need not extend across the entire width of the body 350. As shown in FIG. 15, a flashlight body 850 may include a mounting slot 860 into which a mounting base 810 may slide, but only from one direction, due to the presence of a sidewall 852 adjacent the slot 860 preventing the slot from extending across the entire width of the body 850. As with the other exemplary mounts discussed herein, the mounting base 810 may have a shoulder surface 862 and the mount slot 860 may have a corresponding shoulder surface 861 which surfaces 861, 862 may be urged against one another by a set screw to immobilize the mounting base 810 within the mount slot 860. Still further, other features may be included in any of the mount bases 410, 710, 810 or mounting features 360, 760, 860, such as detents, tabs, or other locking features that may be used to retain the mount base 410, 710, 810 within the flashlight body 350, 750, 850.

Concerning certain of the terms used herein, the term battery is used to refer to an electro-chemical device comprising one or more electro-chemical cells and/or fuel cells, and so a battery may include a single cell or plural cells, whether as individual units or as a packaged unit. A battery is one example of a type of an electrical power source suitable for a portable or other device. Such devices could include power sources including, but not limited to, fuel cells, super capacitors, solar cells, and the like. Any of the foregoing may be intended for a single use or for being rechargeable or for both.

Various embodiments of a battery may have one or more battery cells, e.g., one, two, three, four, or five or more battery cells, as may be deemed suitable for any particular device. A battery may employ various types and kinds of battery chemistry types, e.g., a carbon-zinc, alkaline, lead acid, nickel-cadmium (Ni—Cd), nickel-metal-hydride (NiMH) or lithium-ion (Li-Ion) battery type, of a suitable number of cells and cell capacity for providing a desired operating time and/or lifetime for a particular device, and may be intended for a single use or for being rechargeable or for both. Examples may include a single use or rechargeable Li-Ion battery typically producing about 3.0-3.5 volts, it being noted that the voltages produced thereby will be higher when approaching full charge and will be lower in discharge, particularly when providing higher current and when reaching a low level of charge, e.g., becoming discharged. As used herein, the term "and/or" encompasses both the conjunctive and the disjunctive cases, so that a phrase in the form "A and/or B" encompasses "A" or "B" or "A and B."

These and other advantages of the present invention will be apparent to those skilled in the art from the foregoing specification. Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as set forth in the claims. In addition, to assist future readers with the interpretation of the claims appended hereto, no claim term should be interpreted to invoke 35 U.S.C. 112(f) unless the terms "means" is expressly recited.

What is claimed is:

1. A flashlight, comprising:

a body having a cavity disposed therein configured to receive one or more batteries, the body having a front end and opposing rear end;

a forward-facing illumination source disposed at the front end of the body and configured to provide a beam of light to illuminate an area in front of the light source; and a mount feature integrally formed on the body to provide a single unitary structure incorporating the mount feature with the body, the mount feature configured to receive a selected one of a plurality of helmet mounts having a mounting base having a shape that is complementary to the shape of the mount feature.

2. A flashlight of claim 1, comprising:

a circuit board disposed within the body;

one or more rear-facing signal lights electrically connected to the circuit board and disposed within the cavity at an orientation to provide light at the rear end of the flashlight; and a flexible translucent boot disposed at the rear end of the body and over the circuit board, the boot having one or more windows disposed in registration with a respective one of the one or more rear-facing signal lights.

3. The flashlight of claim 2, wherein the one or more rear-facing signal lights are disposed on the circuit board.

4. The flashlight of claim 2, comprising a switch on the circuit board in electrical communication with the one or more rear-facing signal lights.

5. The flashlight of claim 2, wherein the one or more windows extend outwardly through respective openings at the rear end of the body.

6. The flashlight of claim 5, wherein the body includes a tail cap disposed over the boot to retain the boot therein, and wherein the respective openings at the rear end of the body are disposed in the tail cap.

7. The flashlight of claim 5, wherein the circuit board includes a switch and the flexible translucent boot includes a pushbutton region disposed in registration with the switch.

8. The flashlight of claim 7, wherein the body includes a tail cap disposed over the boot to retain the boot therein, and wherein the pushbutton region is disposed in a button opening in the tail cap.

9. The flashlight of claim 2, wherein the one or more rear-facing signal lights comprise an LED.

10. The flashlight of claim 2, wherein the circuit board comprises control circuitry configured to control the one or more rear-facing signal lights.

11. The flashlight of claim 10, wherein the control circuitry is configured to energize the one or more rear-facing signal lights in a flashing pattern.

12. The flashlight of claim 10, wherein the switch is electrically connected to the control circuitry.

13. The flashlight of claim 1, wherein the mount feature comprises a recess within the body.

14. The flashlight of claim 13, comprising at least one helmet mount having a mounting base with a shape that is configured to be disposed in the recess.

15. The flashlight of claim 14, wherein the mounting base has a shape that is complementary to the recess.

16. The flashlight of claim 13, wherein the mount feature has a longitudinal axis oriented perpendicular to a longitudinal axis extending along the length of the cavity of the body.

17. A flashlight system comprising the flashlight of claim 1 in combination with at least one helmet mount having a mounting base having a shape that is complementary to the shape of, and disposed within, the mount feature.

18. The flashlight system of claim 17, wherein the at least one helmet mount comprises a plurality of helmet mounts each having an identically shaped mounting base and each helmet mount having a different upper mounting structure from one another for securing the flashlight to an object, a selected one of which helmet mounts is disposed in the mount feature.

19. The flashlight system of claim 18, wherein the upper mounting structure of a first one of the plurality of helmet mounts includes a clamp and wherein the upper mounting structure of a second one of the plurality of helmet mounts includes a mounting tab.

* * * * *